United States Patent [19]

Linstromberg et al.

[11] Patent Number: 4,649,718

[45] Date of Patent: Mar. 17, 1987

[54] ICE MAKER WITH ANTI-CAPILLARITY MEANS

[75] Inventors: William J. Linstromberg, Lincoln Township, Berrien County, Mich.; Ralph Tate, Jr.; Robert H. O. Kraemer, both of Center Township, Vanderburgh County, Ind.

[73] Assignee: Whirlpool Corporation, Benton Harbor, Mich.

[21] Appl. No.: 809,947

[22] Filed: Dec. 17, 1985

[51] Int. Cl.[4] ..... F25C 1/04

[52] U.S. Cl. ..... 62/340; 62/347

[58] Field of Search ..... 62/340, 347, 351, 352, 62/344

[56] References Cited

U.S. PATENT DOCUMENTS

| | | | |
|---|---|---|---|
| 2,212,405 | 8/1940 | Rose et al. | 62/351 X |
| 2,857,748 | 10/1958 | Nelson | 62/344 X |
| 2,946,202 | 7/1960 | Boeing | 62/135 |
| 2,967,406 | 1/1961 | Buzicky | 62/340 |
| 2,982,111 | 5/1961 | Dahl | 62/344 X |
| 2,987,895 | 6/1961 | Loewenthal | 62/351 |
| 2,996,895 | 8/1961 | Lippincott | 62/340 X |
| 3,252,293 | 5/1966 | Frei, Sr. | 62/344 X |
| 3,623,336 | 11/1971 | Fox | 62/344 X |
| 3,638,903 | 2/1972 | Pietrzak et al. | 249/69 |
| 3,806,077 | 4/1974 | Pietrzak et al. | 249/69 |
| 4,233,819 | 11/1980 | Stottmann | 62/340 X |
| 4,341,087 | 7/1982 | Van Steenburgh, Jr. | 62/233 |
| 4,458,503 | 7/1984 | Nelson | 62/347 |

*Primary Examiner*—William E. Tapolcai

*Attorney, Agent, or Firm*—Wood, Dalton, Phillips, Mason & Rowe

[57] ABSTRACT

In an ice maker having a mold defining at least one upwardly opening ice body forming cavity and a peripheral wall defining a top, structure for providing at least approximately 3 mm. clearance between components mounted to the mold and the mold wall top for preventing water which may be deposited on the mold wall top from being drawing by capillarity downwardly between the wall and mounted component. The structure further defines a drain for draining any liquid which may be deposited in the clearance space. The invention comprehends the provision of such a clearance spacing illustratively between the housing of a control mounted to the ice maker mold, the ice stripper mounted to the ice maker mold, and the water supply trough mounted to the ice maker mold.

19 Claims, 6 Drawing Figures

FIG. 1
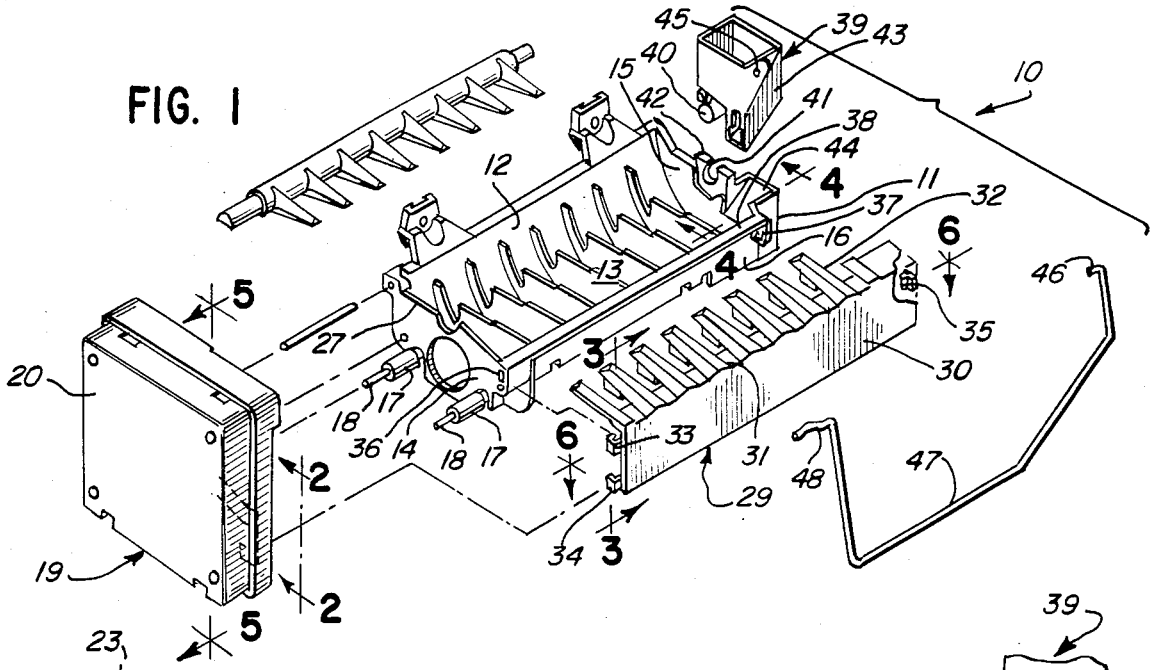
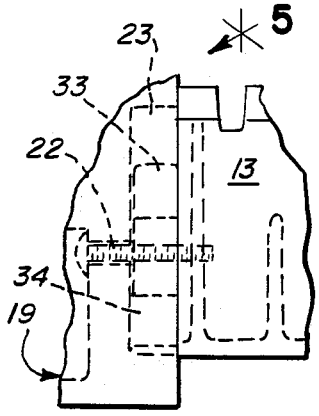
FIG. 2
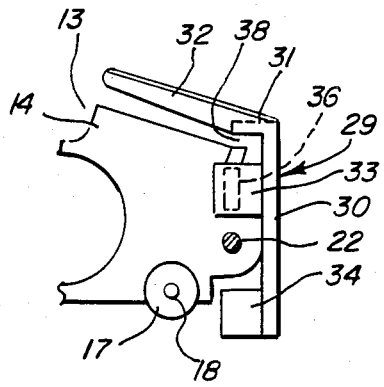
FIG. 3
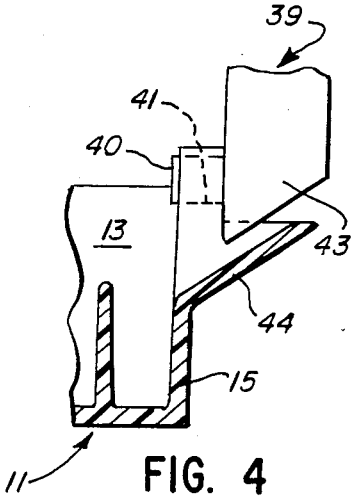
FIG. 4
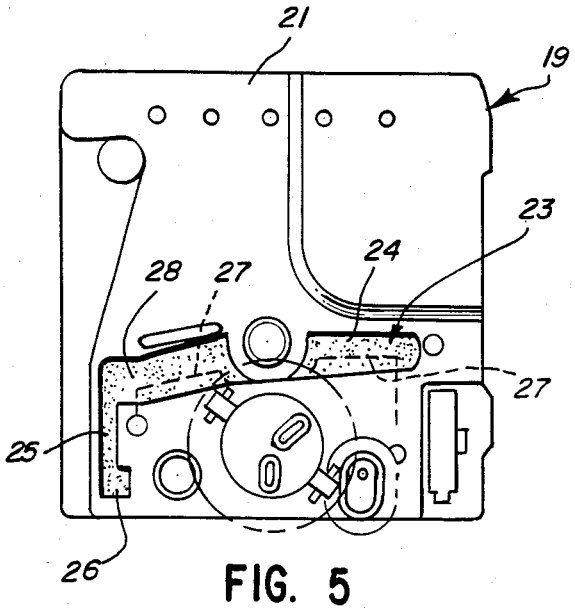
FIG. 5
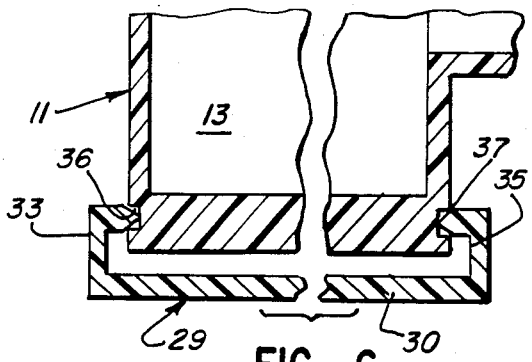
FIG. 6

ICE MAKER WITH ANTI-CAPILLARITY MEANS

BACKGROUND OF THE INVENTION

1. Field of the Invention

This invention relates to ice makers and in particular to means for preventing deposition of water by capillarity between the ice maker mold and confronting surfaces of components mounted thereto.

2. Description of the Background Art

In one conventional form of ice maker adapted to be mounted in a below-freezing compartment of a refrigeration apparatus, the ice maker is provided with an upwardly open mold to which are affixed a number of different components, including a control housing, a stripper for urging the formed ice bodies from the mold into a subjacent collecting bin, and a water inlet trough.

As these elements are mounted so as to be closely juxtaposed to the mold, a number of narrow crevices between the edge of the mold and the confronting surfaces of the elements results wherein water in the mold and water remaining behind from melted ice fragments may be drawn thereinto by capillary action. This has caused a vexatious problem in such ice makers in that such water in the crevices may damage the ice maker as a result of the subsequent freezing and expansion thereof.

One conventional attempt to solve this problem has been to deposit a sealant, such as a silicone sealant, in the crevices. The sealant is conventionally applied to the edge of the ice mold before the components are mounted thereto. This procedure is time-consuming and expensive in that it involves an extra production step and utilizes a relatively costly sealant material. Further, the use of such sealant renders the disassembly and repair of the ice maker more difficult and messy.

SUMMARY OF THE INVENTION

The present invention comprehends an improved ice maker construction wherein the capillarity/deposition of water between the ice mold and components mounted thereto is effectively eliminated without recourse to provision of sealant materials and the like therebetween.

More specifically, the invention comprehends the provision of such an ice maker structure wherein at least one of the confronting surfaces between the ice mold and each of the mounted components is arranged so as to define a clearance of at least 3 mm. so as to effectively prevent such capillarity and thereby effectively avoid the drawing of liquid from the ice mold to between the ice mold edge portions and the mounted components.

In the illustrated embodiment, the control means is provided with a housing having a recess which extends at least 3 mm. above and below the edge of the mold adjacent the housing.

The invention further comprehends the provision of an ice stripper arranged to define a clearance of at least 3 mm. between the side edge of the mold and the body of the ice stripper to avoid the establishment of capillarity therebetween.

Still further, the invention comprehends the provision of a water inlet trough having a discharge chute which is arranged to be spaced from the edge of the ice mold at least 3 mm. so as to prevent establishment of capillarity therebetween.

In broad aspect, the invention comprehends the provision in an ice maker having a mold provided with a peripheral wall portion defining a top and an element closely juxtaposed to said mold wall portion top, of positioning means for preventing water which may be deposited on said wall portion top from being drawn by capillarity downwardly between the wall portion and the element, the positioning means comprising means for spacing the element at least approximately 3 mm. from the wall portion at said top.

In one embodiment, the element is provided with a recess and the positioning means mounts the element to the mold so as to cause the recess to define at least an approximately 3 mm. clearance between the element and the mold.

In the illustrated embodiment, the recess defines a downwardly extending drain portion for draining liquid from the recess.

The improved ice maker structure of the present invention is extremely simple and economical, while yet effectively avoiding the vexatious problem of capillarity-induced migration and deposition of water between the ice maker mold and components mounted thereto.

BRIEF DESCRIPTION OF THE DRAWING

Other features and advantages of the invention will be apparent from the following description taken in connection with the accompanying drawing wherein:

FIG. 1 is an exploded isometric view of an ice maker embodying the invention;

FIG. 2 is a fragmentary vertical elevation taken substantially along the line 2—2 of FIG. 1;

FIG. 3 is a fragmentary vertical elevation taken substantially along the line 3—3 of FIG. 1;

FIG. 4 is a fragmentary vertical section taken substantially along the line 4—4 of FIG. 1;

FIG. 5 is an end elevation of the control of the ice maker taken substantially along the line 5—5 of FIG. 1; and FIG. 6 is a fragmentary plan section taken substantially along the line 6—6 of FIG. 1.

DESCRIPTION OF THE PREFERRED EMBODIMENT

In the exemplary embodiment of the invention as disclosed in the drawing, an ice maker generally designated 10 is shown to include a mold 11 having an upstanding peripheral wall portion 12 defining an upwardly opening ice making space 13.

Wall portion 12 includes a front wall portion 14, a rear wall portion 15, and a side wall portion 16.

The mold is provided with an electrical heater 17 defining male terminals 18 connected to the control generally designated 19 mounted within a housing 20.

Housing 20 includes a rear wall 21, which is secured to front wall 14 of the mold by suitable screws 22.

As best seen in FIG. 5, housing rear wall 21 defines an L-shaped, rearwardly opening recess 23 having a generally horizontal upper portion 24 and a vertical downwardly extending portion 25 terminating in an inturned end portion 26. As illustrated diagrammatically in broken lines in FIG. 5, a top edge 27 of the mold front wall portion 14 is aligned generally with the midportion of the upper portion 24 of the recess. The recess is at least 3 mm. deep and defines a clearance with the top edge 27 of the mold front wall that is at least 3mm. in all directions, which has been found to effectively avoid migration of water from the mold to between and mold front wall 14 and control housing wall 21 by capillarity, without the need for sealant or the like to prevent such migration therebetween.

As further shown in FIG. 5, any liquid which may be deposited on the housing rear wall 21 in recess portion 24, as from splashing of water in the mold space 13, is caused to be drained downwardly from a lower end 28 of horizontal portion 24, through the vertical recess portion 25 and inturned end 26, which is disposed below the mold. Therefore, although the features of the invention prevent water from being drawn into the space between housing wall 21 and mold wall portion 15, if any water does find its way into the recess, it will not remain there but will be drained away by the force of gravity. The recess extends at least 3 mm. above and below the edge 27 of the mold and, thus, housing wall 21 is effectively spaced from the mold edge 27 at least 3 mm. along the entire length of the edge.

Another element, or ice maker component, removably mounted to the mold comprises an ice stripper generally designated 29, having a sidewall 30 and a top wall 31. The top wall 31 is provided with a plurality of cantilevered stripper fingers 32 extending over the ice maker space 13 in the assembled arrangement of the ice maker, as illustrated fragmentarily in FIG. 3.

Sidewall 30 of the ice stripper is mounted to the mold 11 by means of returned connectors 33 and 34 on the front edge of the sidewall, and 35 on the rear edge thereof. Connector 33 is received in a complementary recess 36 in the front wall portion 14 of the mold, and connector 35 is received in a complementary recess 37 in the rear wall portion 15 thereof.

Connector 34 is received in the inturned end portion 26 of recess 23 in housing rear wall 21, and connector 33 is partially received in the end portion 28 of recess portion 24, in the assembled arrangement of the ice maker.

As illustrated in FIG. 3, the mounting of the ice stripper to the mold by means of the connectors is preselected so as to provide a clearance between all portions of the ice stripper and top edge 38 of sidewall 16 of the mold, of at least 3 mm. so as to effectively prevent migration of water therebetween by capillarity. Further, any liquid which may splash onto the top edge surfaces may be drained therefrom through the clearance between the ice stripper sidewall 30 and the mold sidewall portion 16, as illustrated in FIG. 3.

The ice maker further includes a water inlet trough element generally designated 39, which is mounted to the rear wall portion 15 of the mold 11 by means of a forwardly extending mounting grommet 40 received in a complementary channel 41 opening upwardly from the mold rear wall. The channel 41 is flanked by a pair of horizontal top surfaces 42 adapted to be engaged by the trough 39 for preventing rocking of the trough on the mold wall. The trough includes an inlet chute portion 43, which is maintained spaced above a complementary inclined portion 44 of the mold rear wall portion at least a minimum of 3 mm. so as to effectively avoid migration of water from the mold space 13 to between the trough 39 and wall portion 44 by capillarity.

The water supply trough 39 is provided with an apertured ear 45 for receiving an inturned end 46 of a bin level sensing arm 47. The arm further includes a front turned portion 48 swingably mounted to the control housing 20.

Relative to the mounting of each of the ice maker components, i.e. the control 19, ice stripper 29, and water inlet trough 39, to the mold, positioning means are provided for preventing water which may be deposited on the top of the mold upstanding peripheral wall from being drawn by capillarity downwardly between the wall and the mounted elements. The invention comprehends that the positioning means comprise means for spacing the element at least approximately 3 mm. from the top of the wall so as to effectively avoid migration of water from the mold wall top between the mold wall and mounted component.

Further in each case, the mounting further defines means for draining any water which might splash into the space between the mold wall and mounted components. Thus, the invention provides a simple and effective solution to the problem of such migration and avoids the need for the unsatisfactory prior attempts at solving the problem, including the use of covers on the mold, the application of silicone sealing material in the crevices, or the forming of the parts with highly accurate fits in an effort to avoid such crevices.

The foregoing disclosure of specific embodiments is illustrative of the broad inventive concepts comprehended by the invention.

I claim:

1. An ice maker assembly comprising:

a mold defining at least one upwardly opening ice body forming cavity, said mold having a peripheral wall portion defining a top;

means for delivering water into said cavity;

an element having a wall portion closely juxtaposed to said top to define a crevice therebetween; and positioning means for preventing water which may be deposited on said mold wall portion top from being drawn by capillarity downwardly through the crevice between said wall portion and element, said positioning means comprising means for spacing said element at least approximately 3 mm. from said wall portion at said top.

2. The ice maker of claim 1 wherein said positioning means comprises means mounting said element to said mold.

3. The ice maker of claim 1 wherein said wall portion top defines a substantially horizontal upper surface.

4. The ice maker of claim 1 wherein said wall portion top comprises an outturned flange having a substantially horizontal upper surface.

5. The ice maker of claim 1 wherein said element includes a portion spaced above said wall portion top at least 3 mm.

6. The ice maker of claim 1 wherein said element comprises an ice stripper having a portion spaced above said mold.

7. The ice maker of claim 1 wherein said positioning means comprises means mounting said element to said mold at a position spaced from said wall portion top.

8. The ice maker of claim 1 wherein said positioning means comprises means mounting said element to said mold at a position below said wall portion top.

9. The ice maker of claim 1 wherein said mold includes partition walls having top edges spaced below said wall portion top.

10. An ice maker comprising:

a mold defining at least one upwardly opening ice body forming cavity, said mold having a peripheral wall portion defining a top;

means for delivering water into said cavity; and operating means having an outer wall portion juxtaposed to said mold to define a crevice therebetween, a portion of said operating means wall portion defining a recess in the crevice confronting said mold wall portion top providing an at least approximately 3 mm. clearance therebetween.

11. The ice maker of claim 10 wherein said recess includes a downwardly extending drain portion for draining liquid from the recess.

12. The ice maker of claim 10 wherein said recess is defined by a top surface spaced above the level of said mold wall portion top at least approximately 3 mm. and an inner surface spaced laterally from said mold wall portion top at least approximately 3 mm.

13. The ice maker of claim 10 further including an element closely juxtaposed to said mold wall portion top and having a retaining portion interlocked with said operating means outer wall portion.

14. The ice maker of claim 10 further including an element closely juxtaposed to said mold wall portion top and having a retaining portion interlocked with said operating means outer wall portion in a portion of said recess.

15. The ice maker of claim 10 wherein said recess includes a downwardly extending drain portion for draining liquid from the recess, said ice maker further including an element closely juxtaposed to said mold wall portion top and having a retaining portion interlocked with said operating means outer wall portion in said drain portion.

16. An ice maker comprising:

a mold defining at least one upwardly opening ice body forming cavity, said mold having a peripheral wall portion defining a top;

means for delivering water into said cavity; and operating means having an outer wall portion juxtaposed to said mold, a portion of said operating means wall portion defining a recess confronting said mold wall portion top providing an at least approximately 3 mm. clearance therebetween, said recess including an upper portion aligned with said mold wall portion top and defined by a downwardly sloped bottom surface, and a lower drain portion extending downwardly from a lower end of said bottom surface for draining liquid form said upper portion of the recess.

17. The ice maker of claim 16 wherein said lower drain portion extends vertically downwardly from the lower end of said bottom surface.

18. The ice maker of claim 16 wherein said downwardly sloped bottom surface is spaced below the level of said mold wall portion top.

19. The ice maker of claim 16 wherein said lower drain portion comprises means for draining liquid from said upper portion of the recess below said mold.

* * * * *